US008641160B2

(12) United States Patent
Kinas et al.

(10) Patent No.: US 8,641,160 B2
(45) Date of Patent: Feb. 4, 2014

(54) PRINT MEDIA BOTTOM PORTION PRINTING

(75) Inventors: Erick Blane Kinas, Camas, WA (US); Alvin Marion Post, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 90 days.

(21) Appl. No.: 13/284,410

(22) Filed: Oct. 28, 2011

(65) Prior Publication Data

US 2013/0106957 A1 May 2, 2013

(51) Int. Cl.

| | |
|---|---|
| ***B41J 29/38*** | (2006.01) |
| ***B41J 2/04*** | (2006.01) |
| ***B41J 2/01*** | (2006.01) |

(52) U.S. Cl.

USPC ..... 347/14; 347/54; 347/102

(58) Field of Classification Search

None

See application file for complete search history.

(56) References Cited

U.S. PATENT DOCUMENTS

| | | | | |
|---|---|---|---|---|
| 7,267,419 | B2 * | 9/2007 | Yamasaki | 347/19 |
| 7,393,078 | B2 * | 7/2008 | Yazawa et al. | 347/19 |
| 7,455,378 | B2 | 11/2008 | Rueby | |
| 7,585,042 | B2 | 9/2009 | Otsuki | |
| 7,717,634 | B1 | 5/2010 | Budelsky et al. | |
| 2006/0285909 | A1 | 12/2006 | Peck et al. | |

FOREIGN PATENT DOCUMENTS

| | | |
|---|---|---|
| JP | 2010-052263 | 3/2010 |

* cited by examiner

*Primary Examiner* — Geoffrey Mruk

(57) ABSTRACT

A method of printing includes ejecting ink drops onto a bottom portion of a print media from ink orifices of a first portion of a printhead; after ejecting ink drops from the first portion of the printhead, advancing the print media; and after advancing the print media, ejecting ink drops onto the bottom portion of the print media from ink orifices of a second portion of the printhead. The second portion of the printhead is smaller than the first portion of the printhead and excludes ink orifices toward an end of the printhead opposite a direction of the advancing of the print media.

10 Claims, 5 Drawing Sheets

PRINT MEDIA BOTTOM PORTION PRINTING

BACKGROUND

When printing on a bottom portion of print media (also referred to as bottom-of-form (BOF) printing), because the print media may be held only by one nip (e.g., an output nip), a free (or unsupported) length of the print media may be unable to resist flexure. Unfortunately, as ink is deposited on the bottom portion of the print media, the free (or unsupported) length of the print media may curl, thereby resulting in smear and/or jam problems.

DETAILED DESCRIPTION

In the following detailed description, reference is made to the accompanying drawings which form a part hereof, and in which is shown by way of illustration specific examples in which the disclosure may be practiced. In this regard, directional terminology, such as "top," "bottom," "front," "back," "leading," "trailing," etc., is used with reference to the orientation of the Figure(s) being described. Because components of examples of the present disclosure can be positioned in a number of different orientations, the directional terminology is used for purposes of illustration and is in no way limiting. It is to be understood that other examples may be utilized and structural or logical changes may be made without departing from the scope of the present disclosure. The following detailed description, therefore, is not to be taken in a limiting sense, and the scope of the present disclosure is defined by the appended claims.

As illustrated and described herein, reducing a number of ink orifices or nozzles that are used while printing to a bottom portion of a print media during subsequent or successive printing operations or passes of a printhead across a bottom portion of the print media reduces a length over which ink is deposited during the subsequent or successive printing operations or passes, thereby helping to reduce a length of the print media over which curl may occur. In addition, advancing the bottom portion of the print media as it is printed helps to move the print media out of the way after it has been printed, and helps to minimize the amount of time that the bottom portion of the print media remains in the print zone, thereby helping to reduce the amount of time that curl of the print media may occur. Furthermore, as bottom-of-form smears often occur during a last pass (i.e., slew) of the printhead across the print media, due to the print media potentially being the wettest and curl of the print media potentially being at a maximum, reducing an unsupported length of the print media in the print zone helps to reduce the curl height, thereby helping to reduce the possibility of smear.

Figure 1:
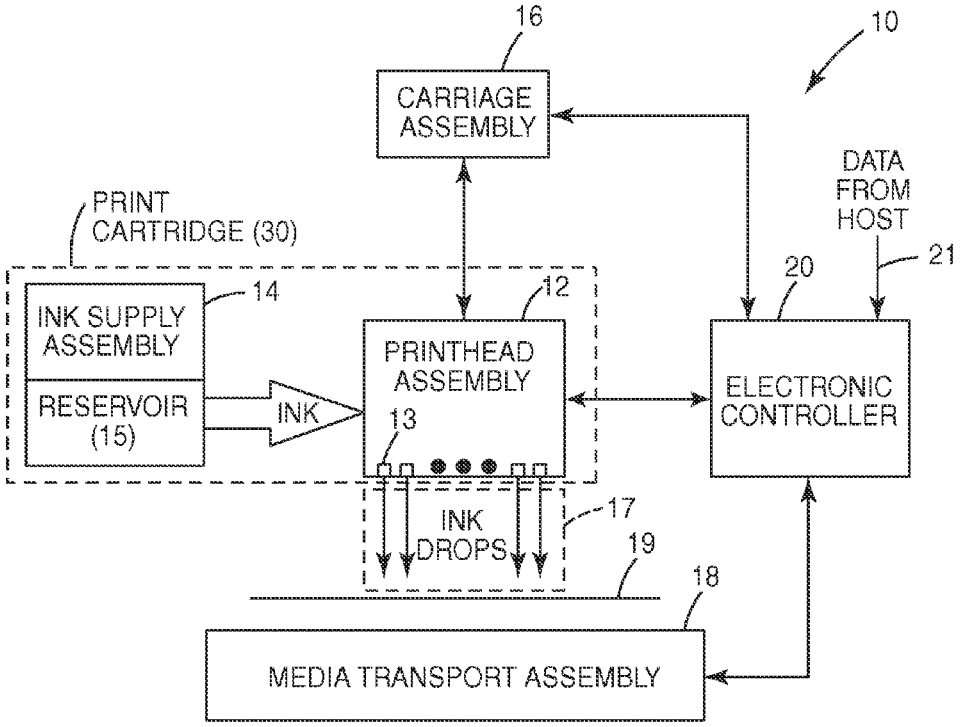
FIG. 1 is block diagram illustrating one example of an ink jet printing system.

FIG. 1 illustrates one example of an inkjet printing system 10. Inkjet printing system 10 includes a fluid ejection assembly, such as printhead assembly 12, and a fluid supply assembly, such as ink supply assembly 14. In the illustrated example, inkjet printing system 10 also includes a carriage assembly 16, a media transport assembly 18, and an electronic controller 20.

Printhead assembly 12 includes one or more printheads or fluid ejection devices which eject drops of ink or fluid through a plurality of orifices or nozzles 13. In one example, the drops are directed toward a medium, such as print medium 19, so as to print onto print media 19. Print media 19 includes any type of suitable sheet material, such as paper, card stock, transparencies, Mylar, fabric, and the like. Typically, nozzles 13 are arranged in one or more columns or arrays such that properly sequenced ejection of ink from nozzles 13 causes characters, symbols, and/or other graphics or images to be printed upon print media 19 as printhead assembly 12 and print media 19 are moved relative to each other.

Ink supply assembly 14 supplies ink to printhead assembly 12 and includes a reservoir 15 for storing ink. As such, in one example, ink flows from reservoir 15 to printhead assembly 12. In one example, printhead assembly 12 and ink supply assembly 14 are housed together in an inkjet or fluid-jet print cartridge or pen, as identified by dashed line 30. In another example, ink supply assembly 14 is separate from printhead assembly 12 and supplies ink to printhead assembly 12 through an interface connection, such as a supply tube.

Carriage assembly 16 positions printhead assembly 12 relative to media transport assembly 18 and media transport assembly 18 positions print media 19 relative to printhead assembly 12. Thus, a print zone 17 is defined adjacent to nozzles 13 in an area between printhead assembly 12 and print media 19. In one example, printhead assembly 12 is a scanning type printhead assembly such that carriage assembly 16 moves printhead assembly 12 relative to media transport assembly 18. In another example, printhead assembly 12 is a non-scanning type printhead assembly such that carriage assembly 16 fixes printhead assembly 12 at a prescribed position relative to media transport assembly 18.

Electronic controller 20 communicates with printhead assembly 12, carriage assembly 16, and media transport assembly 18. Thus, in one example, when printhead assembly 12 is mounted in carriage assembly 16, electronic controller 20 and printhead assembly 12 communicate via carriage assembly 16.

Electronic controller 20 receives data 21 from a host system, such as a computer, and may include memory for temporarily storing data 21. Data 21 may be sent to inkjet printing system 10 along an electronic, infrared, optical or other information transfer path. Data 21 represents, for example, a document and/or file to be printed. As such, data 21 forms a print job for inkjet printing system 10 and includes one or more print job commands and/or command parameters.

In one example, electronic controller 20 provides control of printhead assembly 12 including timing control for ejection of ink drops from nozzles 13. As such, electronic controller 20 defines a pattern of ejected ink drops which form characters, symbols, and/or other graphics or images on print media 19. Timing control and, therefore, the pattern of ejected ink drops, is determined by the print job commands and/or command parameters. In one example, logic and drive circuitry forming a portion of electronic controller 20 is located on printhead assembly 12. In another example, logic and drive circuitry forming a portion of electronic controller 20 is located off printhead assembly 12.

FIGS. 2A-2D schematically illustrate one example of printing on print media 19 by a printhead 40, as an example of printhead assembly 12. More specifically, FIGS. 2A-2D schematically illustrate one example of printing on a bottom portion 191 of print media 19 by printhead 40. As schematically illustrated in the example of FIGS. 2A-2D, bottom portion 191 of print media 19 includes a trailing end 192, and is fed through print zone 17 for printing on bottom portion 191, as described below. Printing on bottom portion 191 of print media 19 may be referred to as bottom-of-form (BOF) printing. In one example, printing on bottom portion 191 of print media 19 includes a multi-pass print operation, as illustrated and described below.

As schematically illustrated in FIGS. 2A-2D, print media 19, including, more specifically, bottom portion 191 of print media 19, is supported by a platen 32. Platen 32 is positioned opposite of printhead 40 such that print media 19 is supported by platen 32 during printing on print media 19 by printhead 40, as described below.

FIGS. 2A-2D also schematically illustrate a portion of media transport assembly 18. Media transport assembly 18 includes feed rollers 181 and output rollers 182 for directing print media 19 between printhead 40 and platen 32, and advancing print media 19 between printhead 40 and platen 32 in a feed or print media advance direction indicated by arrow 11. Feed rollers 181 are provided on an entry side of print zone 17, and output rollers 182 are provided on an exit side of print zone 17. As such, feed rollers 181 are positioned "upstream" of printhead 40 and print zone 17 on a pre-print side of printhead 40 relative to feed direction 11. In addition, output rollers 182 are positioned "downstream" of printhead 40 and print zone 17 on a post-print side of printhead 40 relative to feed direction 11. Media transport assembly 18 may also include one or more other media transport rollers 183 for guiding print media 19 through print zone 17.

Figure 2A:
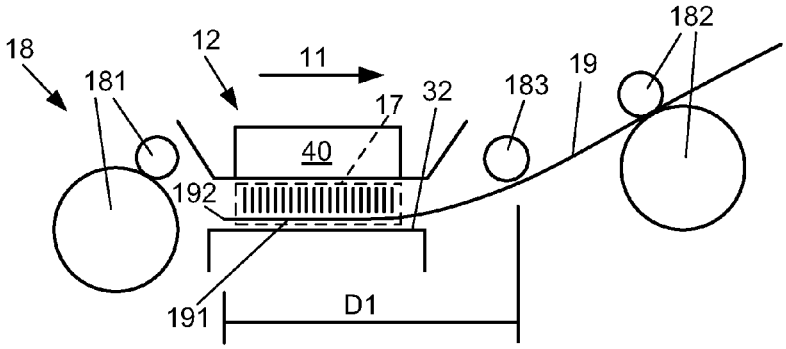
FIGS. 2A-2D schematically illustrate one example of printing on a bottom portion of print media.

As illustrated in FIG. 2A, bottom portion 191 of print media 19 is positioned in print zone 17 and supported by platen 32. In one example, bottom portion 191 of print media 19 extends through print zone 17 such that trailing end 192 of print media 19 is provided at or extends beyond an upstream or pre-dash print side of printhead 40. In the illustrated example of FIG. 2A, a "free-length" of print media 19 is indicated by dimension D1. Free-length D1 represents a length of print media 19 unsupported by media transport assembly 18 during printing on bottom portion 191 of print media 19.

With print media 19 positioned within print zone 17, as illustrated in FIG. 2A, printhead 40 traverses print media 19 in a direction substantially perpendicular to the direction of print media advance indicated by arrow 11 (i.e., in a direction in and out of the plane of the drawing sheet). As such, printhead 40 prints on print media 19 including, more specifically, bottom portion 191 of print media 19, and creates a print swath or a portion of a print swath on print media 19.

In one example, FIG. 2A represents a first printing operation completed during a first pass of printhead 40 across bottom portion 191 of print media 19. As schematically illustrated in FIG. 2A, ink orifices 13 (FIG. 1) extending along substantially a full length of printhead 40 are used for printing on bottom portion 191 of print media 19 during the first printing operation and first pass of printhead 40 across print media 19.

Figure 2B:
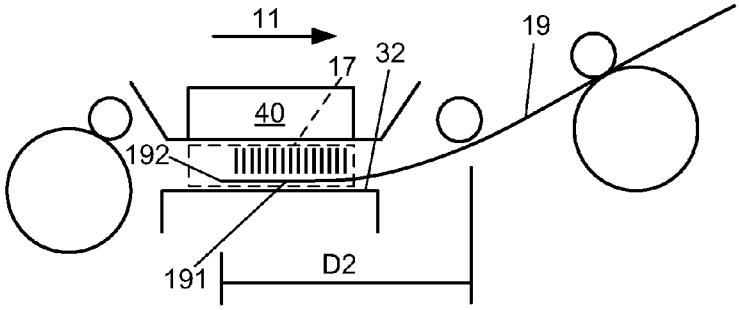

As illustrated in FIG. 2B, once the first printing operation of FIG. 2A has been completed, print media 19 is advanced an incremental distance in the direction of print media advance indicated by arrow 11 such that bottom portion 191 of print media 19 extends into print zone 17 and trailing end 192 of print media 19 is position within print zone 17. As such, a free-length of print media 19, as indicated by dimension D2, is less than free-length D1 of print media 19 illustrated in FIG. 2A.

With print media 19 positioned within print zone 17, as illustrated in FIG. 2B, printhead 40 again traverses print media 19 in a direction substantially perpendicular to the direction of print media advance indicated by arrow 11. As such, printhead 40 prints on print media 19 including, more specifically, bottom portion 191 of print media 19, and creates a print swath or a portion of a print swath on print media 19.

In one example, FIG. 2B represents a second printing operation completed during a second pass of printhead 40 across bottom portion 191 of print media 19. As schematically illustrated in FIG. 2B, ink orifices 13 (FIG. 1) extending along less than a full length of printhead 40 are used for printing on bottom portion 191 of print media 19 during the second printing operation and second pass of printhead 40 across print media 19.

In one example, ink orifices 13 (FIG. 1) extending along approximately three-fourths of printhead 40 are used for printing during the second printing operation and the second pass of printhead 40 across print media 19. In addition, and more specifically, ink orifices 13 (FIG. 1) used for printing during the second printing operation and second pass of printhead 40 across print media 19 include ink orifices 13 positioned toward a downstream or post-print side of printhead 40. As such, ink orifices 13 positioned toward an upstream or pre-print side of printhead 40 are excluded from use during the second printing operation and second pass of printhead 40 across print media 19.

Figure 2C:
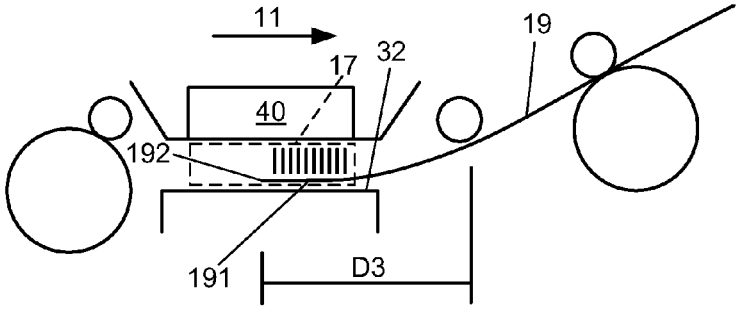

As illustrated in FIG. 2C, once the second printing operation of FIG. 2B has been completed, print media 19 is advanced an incremental distance in the direction of print media advance indicated by arrow 11 such that bottom portion 191 of print media 19 extends into print zone 17 and trailing end 192 of print media 19 remains positioned within print zone 17. As such, a free-length of print media 19, as indicated by dimension D3, is less than free-length D2 of print media 19 illustrated in FIG. 2B.

With print media 19 positioned within print zone 17, as illustrated in FIG. 2C, printhead 40 again traverses print media 19 in a direction substantially perpendicular to the direction of print media advance indicated by the arrow 11. As such, printhead 40 prints on print media 19 including, more specifically, bottom portion 191 of print media 19, and creates a print swath or a portion of a print swath on print media 19.

In one example, FIG. 2C represents a third printing operation completed during a third pass of printhead 40 across bottom portion 191 of print media 19. As schematically illustrated in FIG. 2C, ink orifices 13 (FIG. 1) extending along less than a full length of printhead 40 are used for printing on bottom portion 191 of print media 19 during the third printing operation and third pass of printhead 40 across print media 19.

In one example, ink orifices 13 (FIG. 1) extending along approximately one-half of printhead 40 are used for printing during the third printing operation and third pass of printhead 40 across print media 19. In addition, and more specifically, ink orifices 13 (FIG. 1) used for printing during the third printing operation and third pass of printhead 40 across print media 19 include ink orifices 13 positioned at one end of printhead 40 toward a downstream or post-print side of printhead 40. As such, ink orifices 13 positioned toward an upstream or pre-print side of printhead 40 are excluded from use during the third printing operation and third pass of printhead 40 across print media 19.

Figure 2D:
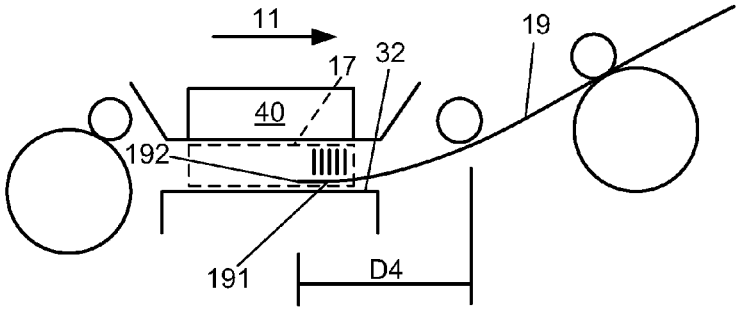

As illustrated in FIG. 2D, once the third printing operation of FIG. 2C has been completed, print media 19 is advanced an incremental distance in the direction of print media advance indicated by arrow 11 such that bottom portion 191 of print media 19 extends into print zone 17 and trailing end 192 of print media 19 remains positions within print zone 17. As such, a free-length of print media 19, as indicated by dimension D4, is less than free-length D3 of print media 19 illustrated in FIG. 2C.

With print media 19 positioned within print zone 17, as illustrated in FIG. 2D, printhead 40 again traverses print media 19 in a direction substantially perpendicular to the direction of print media advance indicated by arrow 11. As such, printhead 40 prints on print media 19 including, more specifically, bottom portion 191 of print media 19, and creates a print swath or a portion of a print swath on print media 19.

In one example, FIG. 2D represents a fourth printing operation completed during a fourth pass of printhead 40 across bottom portion 191 of print media 19. As schematically illustrated in FIG. 2D, ink orifices 13 (FIG. 1) extending along less than a full length of printhead 40 are used for printing on bottom portion 191 on print media 19 during the fourth printing operation and fourth pass of printhead 40 across print media 19.

In one example, ink orifices 13 (FIG. 1) extending along approximately one-fourth of printhead 40 are used for printing during the fourth printing operation and fourth pass of printhead 40 across print media 19. In addition, and more specifically, ink orifices 13 (FIG. 1) used for printing during the fourth printing operation and fourth pass of printhead 40 across print media 19 include ink orifices 13 positioned at one end of printhead 40 toward a downstream or post-print side of printhead 40. As such, ink orifices 13 positioned toward an upstream or pre-print side of printhead 40 are excluded from use during the fourth printing operation and fourth pass of printhead 40 across print media 19.

Figure 3:
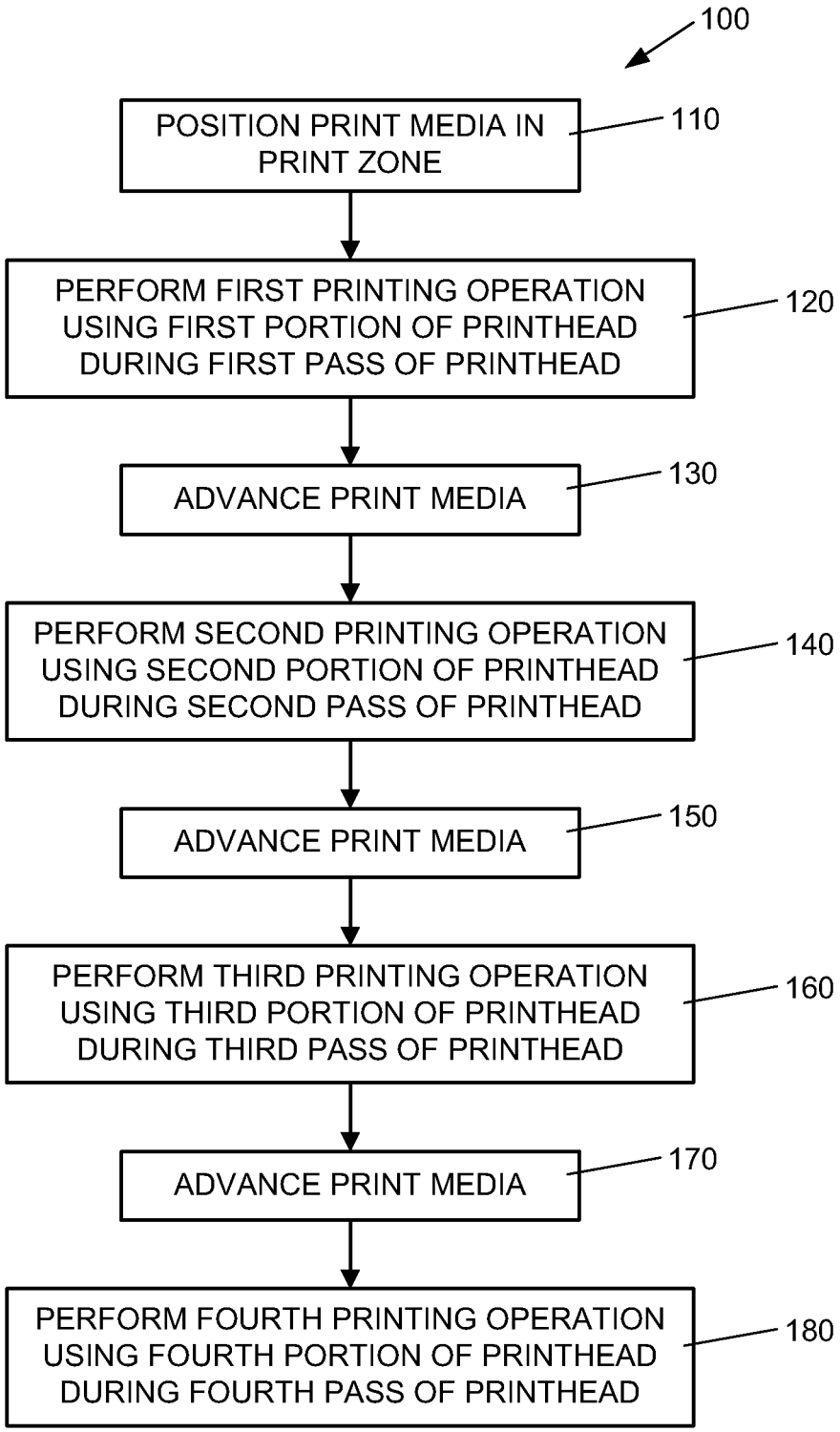
FIG. 3 is a flow diagram illustrating one example of a method of printing on a bottom portion of print media.

FIG. 3 is a flow diagram illustrating one example of a method 100 of printing on print media 19. At 110, and as illustrated in FIG. 2A, print media 19, including, more specifically, bottom portion 191 of print media 19, is positioned in print zone 17 to establish a first position of bottom portion 191 of print media 19 in print zone 17. As such, at 120, and with bottom portion 191 of print media 19 positioned in print zone 17 as illustrated in FIG. 2A, a first printing operation using a first portion of printhead 40 during a first pass of printhead 40 across print media 19 is performed. As described above, and as schematically illustrated in FIG. 2A, during the first printing operation, ink orifices 13 (FIG. 1) extending along substantially a full length of printhead 40 are used for printing on bottom portion 191 of print media 19 during the first printing operation and first pass of printhead 40 across print media 19.

Next, at 130, and as illustrated in FIG. 2B, print media 19 is advanced in the direction indicated by arrow 11 to establish a second position of bottom portion 191 of print media 19 in print zone 17. As such, at 140, and with bottom portion 191 of print media 19 positioned in print zone 17 as illustrated in FIG. 2B, a second printing operation using a second portion of printhead 40 during a second pass of printhead 40 across print media 19 is performed. As described above, and as schematically illustrated in FIG. 2B, during the second printing operation, ink orifices extending along approximately three-fourths of printhead 40 are used for printing on bottom portion 191 of print media 19 during the second printing operation and second pass of printhead 40 across print media 19.

Next, at 150, and as illustrated in FIG. 2C, print media 19 is advanced in the direction indicated by arrow 11 to establish a third position of bottom portion 191 of print media 19 in print zone 17. As such, at 160, and with bottom portion 191 of print media 19 positioned in print zone 17 as illustrated in FIG. 2C, a third printing operation using a third portion of printhead 40 during a third pass of printhead 40 across print media 19 is performed. As described above, and as schematically illustrated in FIG. 2C, during the third printing operation, ink orifices 13 extending along approximately one-half of printhead 40 are used for printing on bottom portion 191 of print media 19 during the third printing operation and third pass of printhead 40 across print media 19.

Next, at 170, and as illustrated in FIG. 2D, print media 19 is advanced in the direction indicated by arrow 11 to establish a fourth position of bottom portion 191 of print media 19 in print zone 17. As such, at 180, and with bottom portion 191 of print media 19 positioned in print zone 17 as illustrated in FIG. 2D, a fourth printing operation using a fourth portion of printhead 40 during a fourth pass of printhead 40 across print media 19 is performed. As described above, and as schematically illustrated in FIG. 2D, during the fourth printing operation, ink orifices extending along approximately one-fourth of printhead 40 are used for printing on bottom portion 191 of print media 19 during the fourth printing operation and fourth pass of printhead 40 across print media 19.

FIGS. 4A-4D schematically illustrate another example of printing on print media 19 by printhead 40. More specifically, FIGS. 4A-4D schematically illustrate another example of printing on bottom portion 191 of print media 19 by printhead 40. As schematically illustrated in the example of Figures of 4A-4D, bottom portion 191 of print media 19 includes trailing end 192 of print media 19, and is fed through print zone 17 for printing on bottom portion 191 of print media 19, as described below. As noted above, printing on bottom portion 191 of print media 19 may be referred to as bottom-of-form (BOF) printing. In addition, in one example, printing on bottom portion 191 of print media 19 includes a multi-pass print operation, as illustrated and described below.

As schematically illustrated in FIGS. 4A-4D, print media 19, including, more specifically, bottom portion 191 of print media 19, is supported by a platen 232. Platen 232 is positioned opposite of printhead 40 such that print media 19 is supported by platen 232 during printing on print media 19 by printhead 40. Similar to that described above with reference to FIGS. 2A-2D, FIGS. 4A-4D also schematically illustrate a portion of media transport assembly 18 including feed rollers 181 and output rollers 182 for directing print media 19 between printhead 40 and platen 232, and advancing print media 19 between printhead 40 and platen 232 in the feed or print media advance direction indicated by arrow 11.

As illustrated in FIGS. 4A-4D, platen 232 includes a series of spaced troughs 233 for capturing or collecting overspray ink when performing or completing a full-bleed print job with printhead 40. A full-bleed print job, also referred to as borderless printing, includes printing to (and beyond) an edge of print media 19. As such, overspray of ink beyond the edge of print media 19 is generated while printing at the edge of print media 19. Accordingly, troughs 233 in platen 232 capture or collect the overspray ink, as described below.

In one example, troughs 233 of platen 232 include a top-of-form (TOF) trough 234, a first bottom-of-form (BOF) trough 235, and a second bottom-of-form (BOF) trough 236. TOF trough 234 is provided in platen 232 toward an end of platen 232 at a downstream side of printhead 40 relative to feed direction 11, and first BOF trough 235 is provided in platen 232 toward an end of platen 232 at an upstream side of printhead 40 relative to feed direction 11. As such, second BOF trough 236 is provided in platen 232 between TOF trough 234 and first BOF trough 235. Accordingly, first BOF trough 235 and second BOF trough 236 capture or collect overspray ink when printing on bottom portion 191 of print media 19, as described below.

Figure 4A:
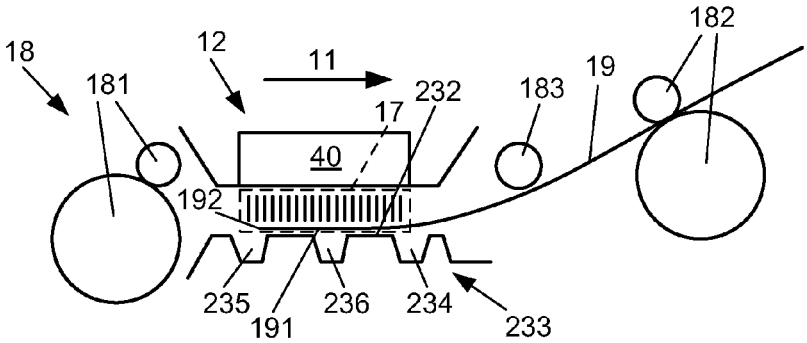
FIGS. 4A-4D schematically illustrate another example of printing on a bottom portion of print media.

As illustrated in FIG. 4A, bottom portion 191 of print media 19 is positioned in print zone 17 and supported by platen 232. In one example, bottom portion 191 of print media 19 is positioned in print zone 17 with trailing end 192 of print media 19 positioned or extended over first BOF trough 235. As such, printhead 40 traverses print media 19 in a direction substantially perpendicular to the direction of print media advance indicated by arrow 11 (i.e., in a direction in and out of the plane of the drawing sheet). Thus, printhead 40 prints on print media 19 including, more specifically, bottom portion 191 of print media 19, and creates a print swath or a portion of a print swath on print media 19.

In one example, FIG. 4A represents a first printing operation completed during a first pass of printhead 40 across bottom portion 191 of print media 19. As schematically illustrated in FIG. 4A, ink orifices 13 (FIG. 1) extending along substantially a full (or entire) length of printhead 40 are used for printing on bottom portion 191 of print media 19 during the first printing operation and first pass of printhead 40 across print media 19. In addition, with trailing end 192 of print media 19 positioned or extended over first BOF trough 235, ink orifices 13 beyond trailing end 192 of print media 19 represent overspray orifices or nozzles of printhead 40 such that first BOF trough 235 captures or collects overspray ink from the overspray orifices or nozzles as printhead 40 performs a printing operation of the full-bleed or borderless print job.

Figure 4B:
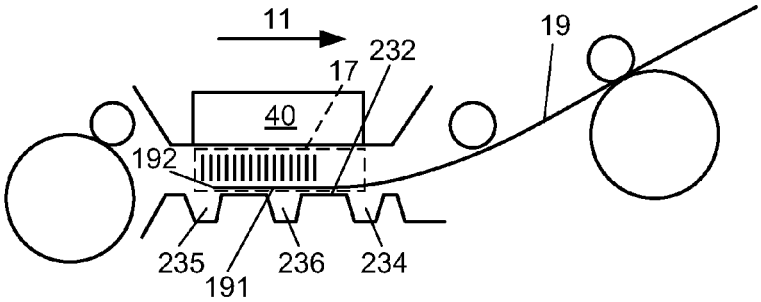

As illustrated in FIG. 4B, with the first printing operation of FIG. 4A completed, print media 19 is held in the position of FIG. 4A. More specifically, the positioning of bottom portion 191 of print media 19 in print zone 17 with trailing end 192 of print media 19 extending over first BOF trough 235 is maintained. As such, printhead 40 again traverses print media 19 in a direction substantially perpendicular to the direction of print media advance indicated by arrow 11. Thus, printhead 40 prints on print media 19 including, more specifically, bottom portion 191 of print media 19, and creates a print swath or a portion of a print swath on print media 19.

In one example, FIG. 4B represents a second printing operation completed during a second pass of printhead 40 across bottom portion 191 of print media 19. As schematically illustrated in FIG. 4B, ink orifices 13 (FIG. 1) extending along less than a full length of printhead 40 are used for printing on bottom portion 191 of print media 19 during the second printing operation and second pass of printhead 40 across print media 19.

In one example, ink orifices 13 (FIG. 1) extending along approximately three-fourths of printhead 40 are used for printing during the second printing operation and second pass of printhead 40 across print media 19. In addition, and more specifically, ink orifices 13 (FIG. 1) used for printing during the second printing operation and second pass of printhead 40 across print media 19 include ink orifices 13 positioned at one end of printhead 40 toward an upstream or pre-print side of printhead 40. As such, ink orifices 13 positioned toward a downstream or post-print side of printhead 40 are excluded from use during the second printing operation and second pass of printhead 40 across print media 19. Furthermore, with trailing end 192 of print media 19 positioned or extended over first BOF trough 235, ink orifices beyond trailing end 192 of print media 19 represent overspray orifices or nozzles of printhead 40 such that first BOF trough 235 captures of collects overspray ink from the overspray orifices or nozzles as printhead 40 performs a printing operation of the full-bleed or borderless print job.

Figure 4C:
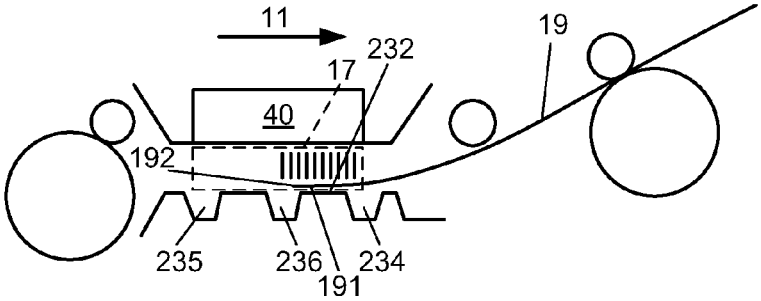

As illustrated in FIG. 4C, once the second printing operation of FIG. 4B has been completed, print media 19 is advanced an incremental distance in the direction of print media advance indicated by arrow 11. More specifically, print media 19 is advanced such that bottom portion 191 of print media 19 is positioned in print zone 17 with trailing end 192 of print media 19 positioned or extended over second BOF trough 236. As such, printhead 40 again traverses print media 19 in a direction substantially perpendicular to the direction of print media advance indicated by arrow 11. Thus, printhead 40 prints on print media 19 including, more specifically, bottom portion 191 of print media 19, and creates a print swath or a portion of a print swath on print media 19.

In one example, FIG. 4C represents a third printing operation completed during a third pass of printhead 40 across bottom portion 191 of print media 19. As schematically illustrated in FIG. 4C, ink orifices 13 (FIG. 1) extending along less than a full length of printhead 40 are used for printing on bottom portion 191 of print media 19 during the third printing operation and third pass of printhead 40 across print media 19.

In one example, ink orifices 13 (FIG. 1) extending along approximately one-half of printhead 40 are used for printing during the third printing operation and third pass of printhead 40 across print media 19. In addition, and more specifically, ink orifices 13 (FIG. 1) used for printing during the third printing operation and third pass of printhead 40 across print media 19 include ink orifices 13 positioned at one end of printhead 40 toward a downstream or post-print side of printhead 40. As such, ink orifices 13 positioned toward an upstream or pre-print side of printhead 40 are excluded from use during the third printing operation and third pass of printhead 40 across print media 19. Furthermore, with trailing end 192 of print media 19 positioned or extended over second BOF trough 236, ink orifices 13 beyond trailing end 192 of print media 19 represent overspray orifices or nozzles of printhead 40 such that second BOF trough 236 captures or collects overspray ink from the overspray orifices or nozzles as printhead 40 performs a printing operation of the full-bleed or borderless print job.

Figure 4D:
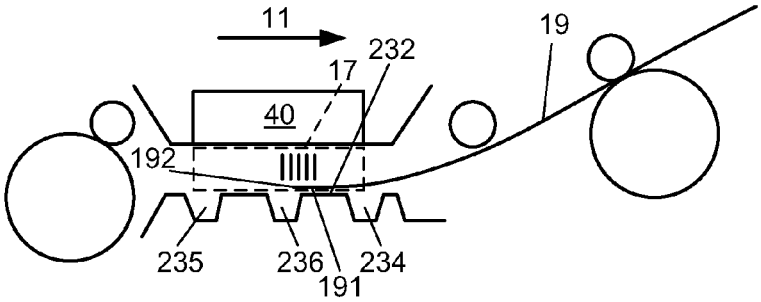

As illustrated in FIG. 4D, with the third printing operation of FIG. 4C completed, print media 19 is held in the position of FIG. 4C. More specifically, the positioning of bottom portion 191 of print media 19 in print zone 17 with trailing end 192 of print media 19 extending over second BOF trough 236 is maintained. As such, printhead 40 again traverses print media 19 in a direction substantially perpendicular to the direction of print media advance indicated by arrow 11. Thus, printhead 40 prints on print media 19 including, more specifically, bottom portion 191 of print media 19, and creates a print swath or a portion of a print swath on print media 19.

In one example, FIG. 4D represents a fourth printing operation completed during a fourth pass of printhead 40 across bottom portion 191 of print media 19. As schematically illustrated in FIG. 4D, ink orifices 13 (FIG. 1) extending along less than a full length of printhead 40 are used for printing on bottom portion 191 of print media 19 during the fourth printing operation and fourth pass of printhead 40 across print media 19.

In one example, ink orifices 13 (FIG. 1) extending along approximately one-fourth of printhead 40 are used for printing during the fourth printing operation and fourth pass of printhead 40 across print media 19. In addition, and more specifically, ink orifices 13 (FIG. 1) used for printing during the fourth printing operation and fourth pass of printhead 40 across print media 19 include ink orifices 13 positioned inward from both ends of printhead 40 and offset from a center portion of printhead 40 in a direction toward a downstream or post-print side of printhead 40. As such, ink orifices positioned toward an upstream or pre-print side of printhead 40 as well as orifices 13 positioned outward toward a downstream or post-print side of printhead 40 are excluded from use during the fourth printing operation and fourth pass of printhead 40 across print media 19. Furthermore, with trailing end 192 of print media 19 positioned or extended over second BOF trough 236, ink orifices 13 beyond trailing end 192 of print media 19 represent overspray orifices or nozzles of printhead 40 such that second BOF trough 236 captures or collects overspray ink from the overspray orifices or nozzles as printhead 40 performs a printing operation of the full-bleed or borderless print job.

Figure 5:
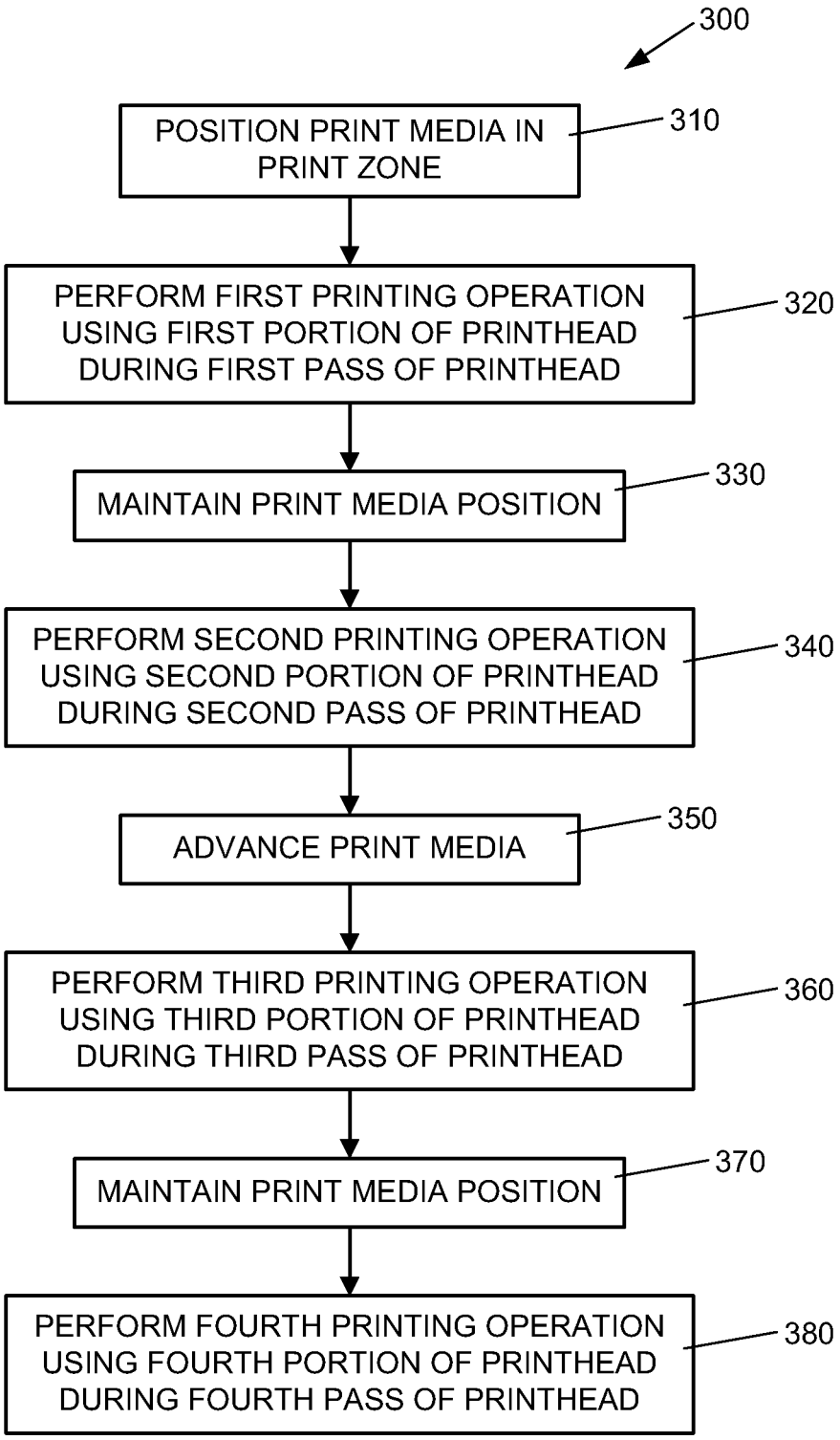
FIG. 5 is a flow diagram illustrating another example of a method of printing on a bottom portion of print media.

FIG. 5 is a flow diagram illustrating one example of a method 300 of printing on print media 19. At 310, and as illustrated in FIG. 4A, print media 19, including, more specifically, bottom portion 191 of print media 19, is positioned in print zone 17 to establish a first position of bottom portion 191 of print media 19 in print zone 17. More specifically, bottom portion 191 of print media 19 is positioned in print zone 17 such that trailing end 192 of print media 19 is positioned or extended over first BOF trough 235.

As such, at 320, and with bottom portion 191 of print media 19 positioned in print zone 17 as illustrated in FIG. 4A, a first printing operation using a first portion of printhead 40 during a first pass of printhead 40 across print media 19 is performed. As described above, and as schematically illustrated in FIG. 4A, during the first printing operation, ink orifices 13 (FIG. 1) extending along substantially a full length of printhead 40 are used for printing on bottom portion 191 of print media 19.

Next, at 330, and as illustrated in FIG. 4B, a position of print media 19 in print zone 17 is maintained. More specifically, the position of bottom portion 191 of print media 19 is maintained such that trailing end 192 of print media 19 extends over first BOF trough 235.

As such, at 340, and with bottom portion 191 of print media 19 positioned in print zone 17 as illustrated in FIG. 4B, a second printing operation using a second portion of printhead 40 during a second pass of printhead 40 across print media 19 is performed. As described above, and as schematically illustrated in FIG. 4B, during the second printing operation, ink orifices 13 (FIG. 1) extending along approximately three-fourths of printhead 40 are used for printing on bottom portion 191 of print media 19.

Next, at 350, and as illustrated in FIG. 4C, print media 19 is advanced in the direction by arrow 11 to establish a second position of bottom portion 191 of print media 19 in print zone 17. More specifically, bottom portion 191 of print media 19 is positioned in print zone 17 such that trailing end 192 of print media 19 is positioned or extended over second BOF trough 236.

As such, at 360, and with bottom portion 191 of print media 19 positioned in print zone 17 as illustrated in FIG. 4C, a third printing operation using a third portion of printhead 40 during a third pass of printhead 40 across print media 19 is performed. As described above, and as schematically illustrated in FIG. 4C, during the third printing operation, ink orifices 13 (FIG. 1) extending along approximately one-half of printhead 40 are used for printing on bottom portion 191 of print media 19.

Next, at 370, and as illustrated in FIG. 4D, a position of print media 19 in print zone 17 is maintained. More specifically, the position of bottom portion 191 of print media 19 is maintained such that trailing end 192 of print media 19 extends over second BOF trough 236.

As such, at 380, and with bottom portion 191 of print media 19 positioned in print zone 17 as illustrated in FIG. 4D, a fourth printing operation using a fourth portion of printhead 40 during a fourth pass of printhead 40 across print media 19 is performed. As described above, and as schematically illustrated in FIG. 4D, during the fourth printing operation, ink orifices 13 (FIG. 1) extending along approximately one-fourth of printhead 40 are used for printing on bottom portion 191 of print media 19.

With the present disclosure, as illustrated and described above in the example of FIGS. 2A-2D and FIG. 3 and the example of FIGS. 4A-4D and FIG. 5, during subsequent or successive printing operations or passes of printhead 40 across bottom portion 191 of print media 19, the number of ink orifices or nozzles 13 of printhead 40 that are used to print on bottom portion 191 of print media 19 is reduced. In addition, the free or unsupported length of print media 19 in print zone 17 is reduced between passes of printhead 40 across bottom portion 191 of print media 19 during the multi-pass printing operation.

As such, by reducing the number of ink orifices or nozzles that are used while printing on the bottom portion of the print media during subsequent or successive printing operations or passes of the printhead across the bottom portion of the print media, a length over which ink is deposited during the subsequent or successive printing operations or passes is also reduced, thereby helping to reduce a length of the print media over which curl may occur. In addition, advancing the bottom portion of the print media as it is printed helps to move the print media out of the way after it has been printed, and helps to minimize the amount of time that the bottom portion of the print media remains in the print zone, thereby helping to reduce the amount of time that curl of the print media may occur. Furthermore, as bottom-of-form smears often occur during a last pass (i.e., slew) of the printhead across the print media, due to the print media potentially being the wettest and curl of the print media potentially being at a maximum, reducing the unsupported length of the print media in the print zone helps to reduce the curl height, thereby helping to reduce the possibility of smear.

Although the examples of FIGS. 2A-2D and FIG. 3 and the examples of FIGS. 4A-4D and FIG. 5 are illustrated and described as including four printing operations or passes of the printhead across the bottom portion of the print media, it is understood that the present disclosure is applicable to other multiples of printing operations or passes of the printhead across the bottom portion of the print media. For example, in addition to the illustrated and described four-pass printing sequences, the present disclosure is also applicable to eight-pass printing sequences as well as other multi-pass printing sequences.

In this regard, as illustrated and described with the four-pass printing sequences of the examples of FIGS. 2A-2D and FIG. 3 and the examples of FIGS. 4A-4D and FIG. 5, and as applicable to other multi-pass printing sequences, an available number of ink orifices of the printhead between subsequent or successive passes of the printhead across the bottom portion of the print media is reduced by a factor of a total number of ink orifices of the printhead divided by a total number of passes of the printhead across the bottom portion of the print media. For example, with the illustrated and described four-pass printing sequences, an available number of ink orifices of the printhead is reduced by a factor of one-fourth (or approximately one-fourth) during each subsequent or successive pass of the printhead across the bottom portion of the print media (i.e., 1, ¾, ½, ¼). Accordingly, an available number of ink orifices of the printhead between subsequent or successive passes of the printhead across the bottom portion of the print media for other multi-pass printing sequences is similarly reduced. While the reduction in the available number of ink orifices of the printhead between subsequent or successive passes of the printhead across the bottom portion of the print media is illustrated and described as being uniform, it is understood that the reduction in the available number of ink orifices of the printhead between subsequent or successive passes of the printhead across the bottom portion of the print media may vary or be non-uniform.

In addition, as illustrated and described with the four-pass printing sequences of the examples of FIGS. 2A-2D and FIG. 3, and as applicable to other multi-pass printing sequences, an incremental distance or amount of advance of the print media between subsequent or successive passes of the printhead across the bottom portion of the print media is a factor of a length of the bottom portion of the print media divided by a total number of passes of the printhead across the bottom portion of the print media. For example, with the illustrated and described four-pass printing sequences of the examples of FIGS. 2A-2D and FIG. 3, an incremental distance or amount of advance of the print media is a factor of one-fourth (or approximately one-fourth) between each subsequent or successive pass of the printhead across the bottom portion of the print media (i.e., ¼, ¼, ¼). Accordingly, an incremental distance or amount of advance of the print media between subsequent or successive passes of the printhead across the bottom portion of the print media for other multi-pass printing sequences is similarly established. While the incremental distance or amount of advance of the print media between subsequent or successive passes of the printhead across the bottom portion of the print media is illustrated and described as being uniform, it is understood that the incremental distance or amount of advance of the print media between subsequent or successive passes of the printhead across the bottom portion of the print media may vary or be non-uniform.

Although specific examples have been illustrated and described herein, it will be appreciated by those of ordinary skill in the art that a variety of alternate and/or equivalent implementations may be substituted for the specific examples shown and described without departing from the scope of the present disclosure. This application is intended to cover any adaptations or variations of the specific examples discussed herein. Therefore, it is intended that this disclosure be limited only by the claims and the equivalents thereof.

What is claimed is:

1. A method of printing, comprising:

ejecting ink drops onto a bottom portion of a print media from ink orifices of a first portion of a printhead;

after ejecting ink drops from the first portion of the printhead, advancing the print media; and after advancing the print media, ejecting ink drops onto the bottom portion of the print media from ink orifices of a second portion of the printhead, the second portion of the printhead smaller than the first portion of the printhead and excluding ink orifices toward an end of the printhead opposite a direction of the advancing of the print media, further comprising:

before ejecting ink drops from the first portion of the printhead, positioning a trailing end of the print media over a first trough of a platen supporting the print media, and wherein advancing the print media includes positioning the trailing end of the print media over a second trough of the platen, the second trough provided between the first trough and a third trough of the platen.

2. The method of claim 1, further comprising:

after ejecting ink drops from the second portion of the printhead, ejecting ink drops onto the bottom portion of the print media from ink orifices of a third portion of the printhead, the third portion of the printhead smaller than the second portion of the printhead; and after ejecting ink drops from the first portion of the printhead, ejecting ink drops onto the bottom portion of the print media from ink orifices of a fourth portion of the printhead, the fourth portion of the printhead smaller than the first portion of the printhead and larger than the second portion of the printhead.

3. The method of claim 2, further comprising:

after ejecting ink drops from the second portion of the printhead and before ejecting ink drops from the third portion of the printhead, maintaining the trailing end of the print media over the second trough of the platen, and after ejecting ink drops from the first portion of the printhead and before ejecting ink drops from the fourth portion of the printhead, maintaining the trailing end of the print media over the first trough of the platen.

4. A printing system, comprising:

a printhead to print on a bottom portion of a print media, the printhead including a first plurality of ink orifices to eject ink drops during a first printing operation and a second plurality of ink orifices to eject ink drops during a second printing operation, the print media advanced in a first direction between the first printing operation and the second printing operation, and the second plurality of ink orifices being less than the first plurality of ink orifices and limited to ink orifices toward an end of the printhead in the first direction; and a platen to support the print media during printing, the platen including a first trough over which a trailing end of the print media is positioned during the first printing operation, and a second trough over which the trailing end of the print media is positioned during the second printing operation, the second trough positioned between the first trough and a third trough of the platen.

5. The system of claim 4, wherein the first printing operation includes a first pass of the printhead across the bottom portion of the print media, and the second printing operation includes a second pass of the printhead across the bottom portion of the print media.

6. The system of claim 5, wherein, between successive passes of the printhead across the bottom portion of the print media, an available number of ink orifices of the printhead is reduced by a factor of a total number of ink orifices of the printhead divided by a total number of passes of the printhead across the bottom portion of the print media.

7. The system of claim 5, wherein, between successive passes of the printhead across the bottom portion of the print media, an incremental distance of advance of the print media is a factor of a length of the bottom portion of the print media divided by a total number of passes of the printhead across the bottom portion of the print media.

8. A method of printing, comprising:

printing on a bottom portion of a print media with a first portion of a printhead during a first pass of the printhead across the print media;

after the first pass of the printhead, printing on the bottom portion of the print media with a second portion of the printhead during a second pass of the printhead across the print media, the second portion of the printhead smaller than the first portion of the printhead;

after the second pass of the printhead, printing on the bottom portion of the print media with a third portion of the printhead during a third pass of the printhead across the print media, the third portion of the printhead smaller than the second portion of the printhead, and the third portion of the printhead provided toward a downstream end of the printhead; and after the third pass of the printhead, printing on the bottom portion of the print media with a fourth portion of the printhead during a fourth pass of the printhead across the print media, the fourth portion of the printhead smaller than the third portion of the printhead, further comprising:

after the first pass of the printhead, maintaining a trailing end of the print media over a first trough of a platen supporting the print media; and after the third pass of the printhead, maintaining the trailing end of the print media over a second trough of the platen, the second trough positioned between the first trough and a third trough of the platen.

9. The method of claim 8, further comprising:

after the second pass of the printhead, advancing the print media.

10. The method of claim 8, wherein the first portion of the printhead includes substantially a full portion of the printhead, the second portion of the printhead includes approximately a three-fourths portion of the printhead, the third portion of the printhead includes approximately a one-half portion of the printhead, and the fourth portion of the printhead includes approximately a one-fourth portion of the printhead.

* * * * *